US010050337B2

(12) United States Patent
Kim et al.

(10) Patent No.: US 10,050,337 B2
(45) Date of Patent: Aug. 14, 2018

(54) V2X ANTENNA AND V2X COMMUNICATION SYSTEM HAVING THE SAME

(71) Applicant: HYUNDAI MOTOR COMPANY, Seoul (KR)

(72) Inventors: Eul Yong Kim, Hwaseong-si (KR); Dong Jin Kim, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 209 days.

(21) Appl. No.: 15/130,584

(22) Filed: Apr. 15, 2016

(65) Prior Publication Data

US 2017/0117619 A1 Apr. 27, 2017

(30) Foreign Application Priority Data

Oct. 22, 2015 (KR) ..... 10-2015-0147132

(51) Int. Cl.

| | |
|---|---|
| ***H01Q 1/32*** | (2006.01) |
| ***H01Q 1/36*** | (2006.01) |
| ***H01Q 1/48*** | (2006.01) |
| ***H01Q 9/04*** | (2006.01) |
| ***H01Q 1/38*** | (2006.01) |
| ***H01Q 9/36*** | (2006.01) |

(52) U.S. Cl.

CPC ..... *H01Q 1/36* (2013.01); *H01Q 1/32* (2013.01); *H01Q 1/3275* (2013.01); *H01Q 1/38* (2013.01); *H01Q 1/48* (2013.01); *H01Q 9/0457* (2013.01); *H01Q 9/36* (2013.01)

(58) Field of Classification Search

CPC ..... H01Q 1/32; H01Q 1/3275; H01Q 1/38; H01Q 1/48; H01Q 9/36; H01Q 9/0457

See application file for complete search history.

(56) References Cited

U.S. PATENT DOCUMENTS

| | | | | |
|---|---|---|---|---|
| 2009/0140927 | A1* | 6/2009 | Maeda | H01Q 9/0407 343/700 MS |
| 2012/0212376 | A1* | 8/2012 | Jan | H01Q 9/0414 343/700 MS |

FOREIGN PATENT DOCUMENTS

| | | | |
|---|---|---|---|
| JP | 2003-163526 | | 6/2003 |
| JP | 2004-328330 | | 11/2004 |
| JP | 2005167911 | A * | 6/2005 |
| JP | 4944719 | | 6/2012 |
| JP | 2013-98786 | | 5/2013 |
| KR | 10-0279696 | B1 | 2/2001 |
| KR | 10-2001-0020244 | A | 3/2001 |
| KR | 20-0470080 | | 11/2013 |
| KR | 20-0470447 | | 12/2013 |
| KR | 10-2015-0117684 | A | 10/2015 |

* cited by examiner

*Primary Examiner* — Dieu H Duong
(74) *Attorney, Agent, or Firm* — Brinks Gilson & Lione

(57) ABSTRACT

A V2X antenna includes: a Z directional radiator, an XY directional radiator extending in the Z direction from a central position of the Z directional radiator, and an induction coupler formed between the Z directional radiator and the XY directional radiator. The induction coupler applies an induced current with a designated level to the Z directional radiator and the XY directional radiator.

16 Claims, 3 Drawing Sheets

V2X ANTENNA AND V2X COMMUNICATION SYSTEM HAVING THE SAME

CROSS-REFERENCE TO RELATED APPLICATIONS

This application claims the benefit of Korean Patent Application No. 10-2015-0147132, filed on Oct. 22, 2015, which is hereby incorporated by reference in its entirety.

FIELD

The present disclosure relates to a V2X antenna and a V2X communication system having the same.

BACKGROUND

The statements in this section merely provide background information related to the present disclosure and may not constitute prior art.

A V2X communication system is a communication system which supports Vehicle to Vehicle (V2V) communication and Vehicle to Infrastructure (V2I) communication, and is used to indicate dangerous situations generated forward in road situations on which vehicles drive, such as expressway situations or general road situations, through communication between vehicles or to propagate dangerous situations to rear vehicles through communication between vehicles or a base station of mobile communication so as to prevent accidents.

Further, the V2X communication system may contribute to traffic accident prevention, such as sensing of front dangerous objects, traffic control, non-stop passing of an emergency vehicle at an intersection, accident prevention of a dead angle zone at an intersection, and pre-detection of approach of a two-wheeled vehicle, according to application services.

Here, a patch antenna which performs directional radiation in the direction of the ground surface (X and Y directions) may be used to execute V2X communication between vehicles, and a monopole antenna which performs non-directional radiation in all directions (Z direction) may be used to execute V2X communication between vehicles and a base station.

If a non-directional antenna is used, radiation is performed in all directions and, thus, gain in a specific direction is low and, if a directional antenna is used, a beam width is narrow and, thus, a shadow region of communication is broad.

SUMMARY

The present disclosure provides a V2X antenna having both directionality and non-directionality which generates strong directionality in a direction in which a counterpart vehicle is located and in a direction in which a communication target is located, and a V2X communication system having the same.

Additional advantages, objects, and features of the present disclosure will be set forth in part in the description which follows and in part will become apparent to those having ordinary skill in the art upon examination of the following or may be learned from practice of the present disclosure. The objectives and other advantages of the present disclosure may be realized and attained by the structure particularly pointed out in the written description and claims hereof as well as the appended drawings.

A V2X antenna includes a Z directional radiator, an XY directional radiator extending in the Z direction from the central position of the Z directional radiator, and an induction coupler formed between the Z directional radiator and the XY directional radiator and applying induced current of a designated level to the Z directional radiator and the XY directional radiator.

The V2X antenna may further include a substrate unit formed along the edge of the Z directional radiator such that the Z directional radiator is formed inside the substrate unit.

The V2X antenna may further include a power feeder formed within the substrate unit, the upper part of the power feeder contacting the lower part of the Z directional radiator.

The V2X antenna may further include a ground part formed at the lower part of the substrate unit and contacting the lower part of the power feeder.

The ground part may be formed of a conductive material.

The induction coupler may be formed in a cross shape starting from the center of the XY directional radiator.

If the induction coupler includes a first induction coupler part formed in the X direction and a second induction coupler part formed in the Y direction and intersecting the first induction coupler part, the length of one side of the first induction coupler part and the length of one side of the second induction coupler part except for the intersection region therebetween may be equal.

The lengths may be within the range of 1.4~1.8 mm.

The width of the end of the first induction coupler part or the second induction coupler part may be within the range of 0.02~2 mm.

The length of one side of the first induction coupler part and the length of one side of the second induction coupler part except for the intersection region therebetween may have different values within the range of 1.4~1.8 mm.

The XY directional radiator may include a first XY directional radiator part having a rod shape and formed at the central position of the Z directional radiator and a second XY directional radiator part having a pillar shape and formed at the upper end of the first XY directional radiator part.

The pillar-shaped second XY directional radiator part may serve as a load.

The Z directional radiator, the XY directional radiator and the induction coupler may be formed of a conductive material.

The XY directional radiator may be operated in a monopole mode and the Z directional radiator may be operated in a patch mode.

The power feeder may be biased in the X direction within the substrate unit so that the Z directional radiator or the XY directional radiator has radiation directivity in the ZX direction, or be biased in the Y direction within the substrate unit so that the Z directional radiator or the XY directional radiator has radiation directivity in the ZY direction.

In another aspect of the present disclosure, a V2X communication system includes a first V2X antenna within a counterpart vehicle, a second V2X antenna of a communication target, and a V2X antenna within a vehicle, connected to the first V2X antenna by first WAVE communication and connected to the second V2X antenna by second WAVE communication.

The V2X antenna may include a Z directional radiator configured to execute the second wave communication, an XY directional radiator extending in the Z direction from the central position of the Z directional radiator so as to execute the first WAVE communication, an induction coupler formed between the Z directional radiator and the XY directional radiator and applying induced current of a designated level to the Z directional radiator and the XY directional radiator, a substrate unit formed along the edge of the Z directional radiator such that the Z directional radiator is formed inside the substrate unit, a power feeder formed within the substrate unit, the upper part of the power feeder contacting the lower part of the Z directional radiator, and a ground part formed at the lower part of the substrate unit and contacting the lower part of the power feeder.

The induction coupler may be formed in a cross shape starting from the center of the XY directional radiator.

If the induction coupler includes a first induction coupler part formed in the X direction and a second induction coupler part formed in the Y direction and intersecting the first induction coupler part, the length of one side of the first induction coupler part and the length of one side of the second induction coupler part except for the intersection region therebetween may be equal within the range of 1.4~1.8 mm.

The XY directional radiator may include a first XY directional radiator part having a rod shape and formed at the central position of the Z directional radiator and a second XY directional radiator part having a pillar shape and formed at the upper end of the first XY directional radiator part, and the pillar-shaped second XY directional radiator part may serve as a load.

The power feeder may be biased in the X direction within the substrate unit so that the Z directional radiator or the XY directional radiator has radiation directivity in the ZX direction, or be biased in the Y direction within the substrate unit so that the Z directional radiator or the XY directional radiator has radiation directivity in the ZY direction.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
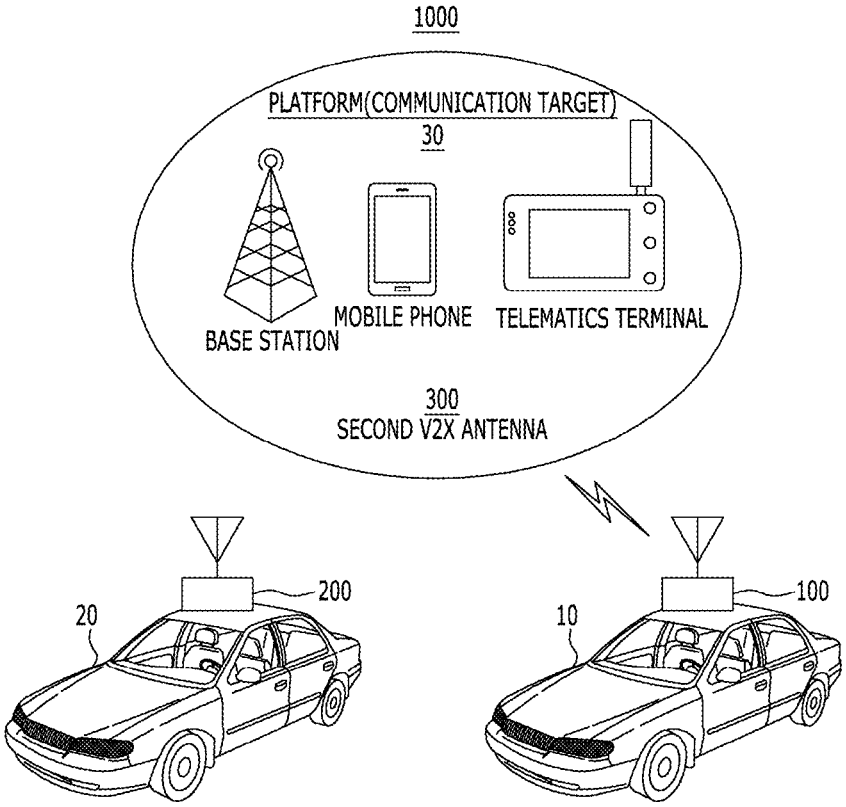
FIG. 1 is a view schematically illustrating one example of a V2X communication system.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The suffixes "module" and "unit" used in the description below are given or used together only in consideration of ease in preparation of the specification and do not have distinctive meanings or functions.

Further, it may be understood that a term "and/or" used in the following description includes all arbitrary and all possible combinations of one or more relevant items which are listed.

In the following description of the forms, it will be understood that the terms "including", "comprising", "consisting of" and "having" mean presence of corresponding elements, unless there is stated otherwise, and does not exclude presence of other elements.

A V2X antenna and a V2X communication system disclosed in the following description have both directivity and non-directivity so as to smoothly transmit and receive data between vehicles and between a vehicle and a communication target connected by WAVE communication standardized by IEEE, and concentrates radiation directivity generated thereby in the ground surface direction (X and Y directions) and all directions (Y direction) in which the counterpart vehicle and the communication target are located, thus improving communication sensitivity with the counterpart vehicle and the communication target.

Further, the V2X antenna and the V2X communication system concentrate radiation directivity, which was in unnecessary directions, in the XZ direction or the YZ direction in which most of counterpart vehicles and communication targets are located as well as in the ground surface direction (X and Y directions) and the upward direction (Z direction), thus realizing a mechanism to more improve communication sensitivity with the counterpart vehicle and the communication target.

Here, communication targets refer to platforms (for example, terminals, communication modules, base stations, etc.) which support Dedicated Short Range communication (DSRC) technology providing an Electronic Toll Collection (ETC) service, cellular communication technology providing a telematics service, broadcasting and communication technology providing traffic information in a wide area, etc.

Further, communication targets may refer to Nomadic devices, such as mobile phones, notebooks and wearable devices.

Hereinafter, in order to improve communication sensitivity with a counterpart vehicle and a communication target connected by V2X communication, a V2X antenna installed in an arbitrary vehicle and a V2X communication system using the same will be described in more detail.

<One Example of V2X Communication System>

FIG. 1 is a view schematically illustrating one example of a V2X communication system.

With reference to FIG. 1, a V2X communication system 1000 includes a V2X antenna 100 within a vehicle 10, a first V2X antenna 200 within a counterpart vehicle 20, and a second V2X antenna 300 of a communication target 30.

The V2X antenna 100 within the vehicle 10 may be connected to the first V2X antenna 200 within the counterpart vehicle 20 through V2X communication (first WAVE communication) and be connected to the second V2X antenna 300 of the communication target 30 through V2X communication (second WAVE communication).

The vehicle 10 and the counterpart vehicle 20 may be driving vehicles or stopped vehicles. Therefore, the first wave communication may be executed between the vehicle 10 and the counterpart vehicle 20 which are driving or stopped.

On the other hand, the communication target 30 may be fixed at a predetermined position or be moving.

For example, if the communication target 30 is a mobile phone, the second wave communication may be executed between the mobile phone 30 carried by a human hand and the vehicle 10. On the other hand, if the communication target 30 is a base station, the second wave communication may be executed between the driving or stopped vehicle 10 and the base station 30 located in a building or at the roadside.

Here, WAVE communication may be executed between the V2X antenna 100 within the vehicle 10 and the first V2X antenna 200 within the counterpart vehicle 20 through non-directivity, for example, not only radiation directivity in which radiation is carried out in the X direction and the Y direction but also radiation directivity in which radiation is carried out in the XZ direction and/or the YZ direction.

Further, WAVE communication may be executed between the V2X antenna 100 within the vehicle 10 and the second V2X antenna 300 of the communication target 30 through directivity, for example, not only radiation directivity in which radiation is carried out in the Z direction (upward direction) but also radiation directivity in which radiation is carried out in the XZ direction and/or the YZ direction.

As described above, by designing the V2X antenna 100 within the vehicle 10 as one communication module functioning as a non-directional antenna and a directional antenna which may cover not only the ground surface direction and the upward direction but also directions located therebetween, radiation directivity in unnecessary directions may be reduced, thus increasing communication sensitivity and reducing manufacturing costs.

Hereinafter, the structure and characteristics of the V2X antenna 100 within the vehicle 10 will be described in more detail.

<One Example of V2X Antenna>

Figure 2:
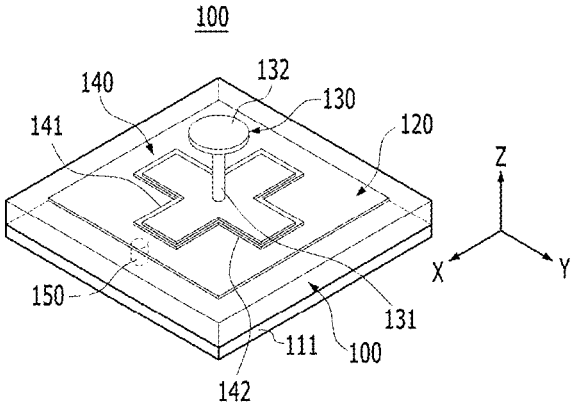
FIG. 2 is a perspective view illustrating one example of a V2X antenna structure.

FIG. 2 is a perspective view illustrating one example of a V2X antenna structure.

With reference to FIG. 2, a V2X antenna 100 may include a substrate unit 110, a Z-directional radiator 120, an XY directional radiator 130, an induction coupler 140 and a power feeder 150.

First, the substrate unit 110 may be formed of a dielectric material and have an approximately rectangular shape. The substrate unit 110 may be formed along the edge of the Z directional radiator 120, which will be described later, such that the Z directional radiator 120 is formed inside the substrate unit 110.

The substrate unit 110 may include a ground part 111 at the lower part thereof. The ground part 111 may be formed of a conductive material so as to be easily grounded.

In accordance with one form of the present disclosure, the Z directional radiator 120 is mounted inside the substrate unit 110. The upper end of the Z directional radiator 120 mounted inside the substrate unit 100 may be manufactured so as to have a height which approximately coincides with the height of the upper end of the substrate unit 110 and an approximately rectangular shape which is the same as the shape of the substrate unit 110.

Through such a structure, in order to execute WAVE communication with the communication target 30, the Z directional radiator 120 may basically have radiation directivity in the Z direction orthogonal to the ground surface in 3D spatial coordinates when induced current is introduced.

In this case, the Z directional radiator 120 may be operated in a patch mode of a patch antenna having a directional radiation pattern.

In order to increase radiation directivity, the Z directional radiator 120 may be formed of a conductive material, for example, copper. However, the disclosure is not limited thereto and the Z directional radiator 120 may be formed of a combination of two or more conductive materials.

In accordance with one form, the XY directional radiator 130 is manufactured in a shape in which the XY directional radiator 130 is located at the central position of the Z directional radiator 120 and extends in the Z direction in the 3D space coordinates.

That is, the XY directional radiator 130 may extend in the Z direction from the central position of the Z directional radiator 120.

The XY directional radiator 130 may be formed of a conductor, for example, copper, and include a first XY directional radiator part 131 having a rod shape and formed at the central position of the Z directional radiator 120 and a second XY directional radiator part 132 having a pillar shape and formed at the upper end of the first XY directional radiator part 131.

Through such a structure, in order to smoothly execute WAVE communication with the counterpart vehicle 20, the XY directional radiator 130 may have non-directivity, i.e., radiation directivity in the ground surface direction, for example, the X direction and the Y direction, in the 3D spatial coordinates when induced current is introduced.

In this case, the XY directional radiator 130 may be operated in a monopole mode of a monopole antenna having a non-directional radiation pattern.

Particularly, the pillar-shaped second XY directional radiator part 132 may be manufactured as a load of a top-loaded type having strong radiation directivity in the X direction and the Y direction so as to execute smoother V2X communication with the counterpart vehicle 20.

In one form, the induction coupler 140 may be formed of a conductor, for example, copper, and formed (mounted) between the Z directional radiator 120 and the XY directional radiator 130.

In order to achieve ease in mounting, the induction coupler 140 may be manufactured so as to have a slit structure and a height of which is approximately equal to the height of the Z directional radiator 120 and may be inserted between the Z directional radiator 120 and the XY directional radiator 130.

The induction coupler 140 may apply induced current of a designated intensity to the Z directional radiator 120 and the XY directional radiator 130, thereby allowing the Z directional radiator 120 and the XY directional radiator 130 to have necessary directional and/or non-directional radiation directivities, as described above.

Here, the shape and length of the induction coupler 140 may influence the amounts of energy (radiation) radiated from the Z directional radiator 120 and the XY direction radiator 130.

That is to say, this may mean that the directional and non-directional radiation directivity patterns and/or radiation directivity intensities radiated from the Z directional radiator 120 and the XY directional radiator 130 are determined by the shape and length of the induction coupler 140.

For example, when the induction coupler 140 is formed in a cross shape starting from the center of the XY directional radiator 130, the Z directional radiator 120 and/or the XY directional radiator 130 may have strong radiation directivity not only in the above-described intrinsic directions but also in the XZ direction and/or the YZ direction.

For this purpose, the cross-shaped induction coupler 140 may include a first induction coupler part 141 formed in the X direction and a second induction coupler part 142 formed in the Y direction and intersecting the first induction coupler part 141.

Radiation characteristics regarding the length of the induction coupler 140 will be described later with reference to FIG. 2.

Finally, the power feeder 150, the upper part of which contacts the lower part of the Z directional radiator 120, and the majority of which is located within the substrate unit 110, may be formed.

Such a power feeder 150 may crucially influence the radiation pattern and/or radiation intensity of the Z directional radiator 120. For example, the radiation directivity patterns and/or radiation directivity intensities of the Z directional radiator 120 and/or the XY directional radiator 130 may be varied according to biased directions of the position of the power feeder 150.

For example, the power feeder 150 which is biased in the X direction may be formed within the substrate unit 110 so that the Z directional radiator 120 and/or the XY directional radiator 130 have strong radiation directivity in the ZX direction.

Thereby, the Z directional radiator 120 may have not only a radiation pattern in the Z direction but also strong radiation directivity in the XZ direction, and/or the XY directional radiator 130 may have not only non-directional radiation directivity in the X direction and Y direction but also strong radiation directivity in the XZ direction.

However, the disclosure is not limited thereto and the power feeder 150 may be located at other positions in the substrate unit 110.

For example, although it is not shown in the drawings, the power feeder 150 which is biased in the Y direction may be formed within the substrate unit 110 so that the Z directional radiator 120 and/or the XY directional radiator 130 have strong radiation directivity in the ZY direction.

In this case, the Z directional radiator 120 may have not only radiation directivity in the Z direction but also strong radiation directivity in the YZ direction, and/or the XY directional radiator 130 may have not only non-directional radiation directivity in the X direction and Y direction but also strong radiation directivity in the YZ direction.

When the Z directional radiator 120 and the XY directional radiator 130 have radiation directivity in the ZY direction and the YZ direction, communication sensitivity to more accurately recognize a counterpart vehicle and a communication target located at a designated height from the ground surface may be increased.

The ground part 111 of the above-described substrate unit 110 is formed at the lower part of the substrate unit 110 and contacts the lower part of the power feeder 150, thus serving as ground of current (induced current) flowing in the Z directional radiator 120 and/or the XY directional radiator 130.

Hereinafter, influence of the length of the induction coupler 140 on directivity characteristics will be described.

Figure 3:
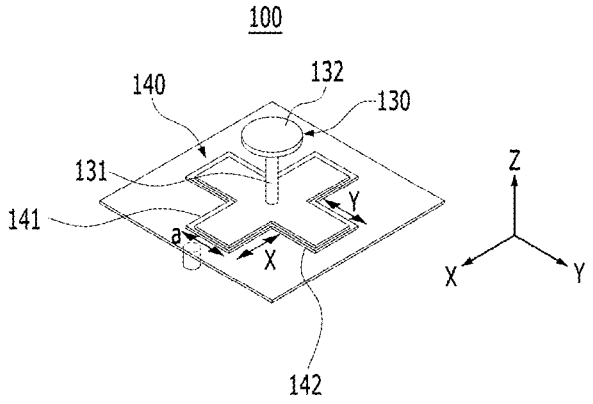
FIG. 3 is an enlarged view illustrating the structure of an induction coupler of FIG. 2.
Figure 4:
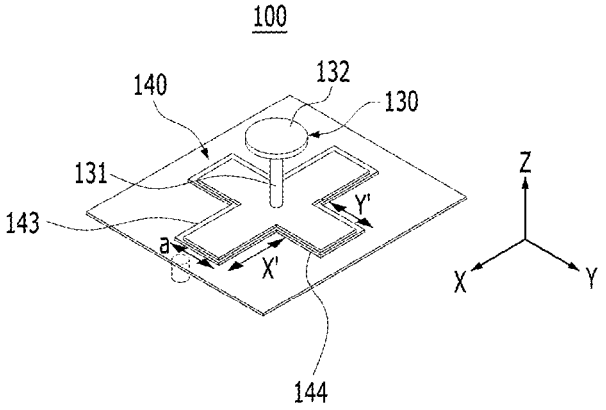
FIG. 4 is an enlarged view illustrating the structure of another type of induction coupler differing from FIG. 3.

FIG. 3 is an enlarged view illustrating the structure of the induction coupler of FIG. 2 and FIG. 4 is an enlarged view illustrating the structure of another type of induction coupler differing from FIG. 3.

With reference to FIG. 3, the induction coupler 140 may include the first induction coupler part 141 formed in the X direction and the second induction coupler part 142 formed in the Y direction and intersecting the first induction coupler part 141.

In this case, the length of one side of the first induction coupler part 141 and the length of one side of the second induction coupler part 142 except for the intersection region of the induction coupler 140 (for example, a length X and a length Y) may be equal. Here, the length X and the length Y may be determined within the range of 1.4~1.8 mm.

For example, when the length X of the first induction coupler part 141 and the length Y of the second induction coupler part 142 exceeds the above-described length range, the amount of an electric field induced in the XY directional radiator 130 increases and thus non-directional radiation directivity in the ground surface direction, i.e., the X direction and the Y direction, is increased, but radiation directivity in the Z direction of the Z directional radiator 120 is decreased in proportion to the increase of non-directional radiation directivity in the ground surface direction. Therefore, the length X and the length Y of the induction coupler 140 are within the above-described range.

Otherwise, when the length X of the first induction coupler part 141 and the length Y of the second induction coupler part 142 are below the above-described length range, radiation directivity in the Z direction of the Z directional radiator 120 is increased, but an inductive coupling amount with the XY directional radiator 130 is decreased and thus non-directional radiation directivity in the X direction and the Y direction is decreased. Therefore, the length X and the length Y of the induction coupler 140 are within the above-described range.

However, the length X of the first induction coupler part 141 and the length Y of the second induction coupler part 142 are not limited to the same length and, for example, may be different, as exemplarily shown in FIG. 4.

That is, with reference to FIG. 4, the length of one side of a third induction coupler part 143 and the length of one side of a fourth induction coupler part 144 except for the intersection region of an induction coupler 140 in accordance with one form (for example, a length X' and a length Y') may be different.

However, although the length X' of the third induction coupler part 143 and the length Y' of the fourth induction coupler part 144 are different, the length X' and the length Y' may have different values within the range of 1.4~1.8 mm. For example, the length X' of the third induction coupler part 143 may be 1.6 mm and the length Y' of the fourth induction coupler part 144 may be 1.4 mm.

Further, differently from FIG. 4, the induction coupler 140 may be manufactured such that the length X' of one side of the third induction coupler part 143 and the length of the other side of the third induction coupler part 143 located at the other side of the intersection region are different and the length Y' of one side of the fourth induction coupler part 144 and the length of the other side of the fourth induction coupler part 144 located at the other side of the intersection region are different.

As described above, various modifications of the lengths may be determined within the range of improving radiation characteristics not only in the X, Y and Z directions but also in the XZ and YZ directions.

The widths a of the ends of the first induction coupler part 141 and/or the second induction coupler part 142 shown in FIG. 3 may be within the range of 0.02~2 mm. Here, the widths "a" of the ends of the first induction coupler part 141 and the second induction coupler part 142 may be equal or different within the range of 0.02~2 mm.

The reason why the first induction coupler part 141 and the second induction coupler part 142 have the above-described end widths "a" is to increase strong radiation directivity in the directions of the counterpart vehicle 20 and the communication target 30. However, the disclosure is not limited thereto and the first induction coupler part 141 and the second induction coupler part 142 may be manufactured to have end widths greater or smaller than the above-described width "a", if it is possible to manufacture these induction coupler parts 141 and 142.

The reason for this is that design of the end widths "a" of the first induction coupler part 141 and the second induction coupler part 142 is less sensitive to radiation characteristics, as compared to design of the length X of the first induction coupler part 141 and the length Y of the second induction coupler part 142.

Example 1 of Directivity Characteristics

Figure 5:
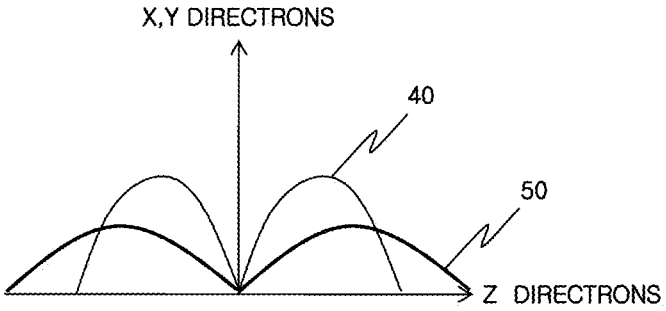
FIG. 5 is a graph illustrating directivity characteristics of a second XY directional radiator part serving as a load of FIG. 2.

FIG. 5 is a graph illustrating directivity characteristics of the second XY directional radiator part serving as a load of FIG. 2.

With reference to FIG. 5, it may be confirmed that, when the V2X antenna 100 includes the second XY directional radiator part 132 serving as a load, a non-directional radiation pattern 40 in the X direction and the Y direction formed thereby has a higher directivity intensity than a conventional radiation pattern 50 (of a monopole antenna without the second XY directional radiator part 132).

That is, the conventional radiation pattern 50 in the X direction and the Y direction shown in FIG. 5 is a little flat and is spread in other directions, for example, in the Z direction or in the downward direction of the ground surface. However, the radiation pattern 40 in the X direction and the Y direction is not radiated in the Z direction or in the downward direction of the ground surface and is concentrated in the X direction and the Y direction.

Example 2 of Directivity Characteristics

Figure 6:
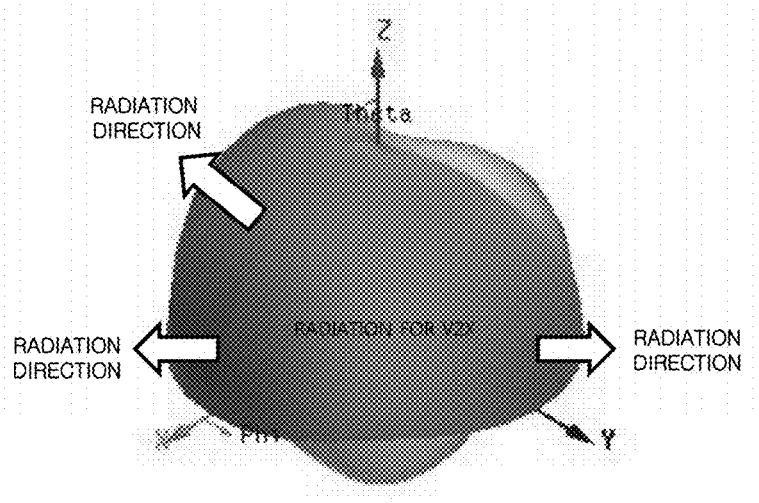
FIG. 6 is a view graphically illustrating one example of a radiation pattern generated from the V2X antenna of FIG. 2.

FIG. 6 is a view graphically illustrating one example of a radiation pattern generated from the V2X antenna of FIG. 2.

With reference to FIG. 6, it may be confirmed that a radiation pattern generated from the above-described V2X antenna, in order to execute smooth wave communication with a counterpart vehicle stopped or driving on the ground surface or at a designated height from the ground surface and a communication target fixed at a position higher than the counterpart vehicle or moving, has a strong radiation directivity pattern and/or a radiation directivity intensity not only in the ground surface direction, i.e., the X direction and the Y direction, but also in the XZ direction and/or the YZ direction in which most communication targets and counterpart vehicles are located.

Particularly, the reason why directivity characteristics in the XZ direction are increased is that the power feeder 150 is biased in the X direction within the substrate unit 110. In this case, it may be confirmed from FIG. 6 that directivity characteristics in the YZ direction as well as directivity characteristics in the XZ direction are improved.

As apparent from the above description, a V2X antenna having improved radiation characteristics in accordance with the present disclosure has effects, as follows.

First, radiation directivity unnecessary for V2X communication is concentrated in directions in which a communication target and/or a counterpart vehicle are located (for example, X, Y, Z, YZ and XZ directions), thus improving communication sensitivity with the counterpart vehicle and/or the communication target.

Second, radiation in unnecessary directions is not executed, thus increasing energy efficiency of a V2X communication system.

It will be apparent to those skilled in the art that various modifications and variations can be made in the present disclosure without departing from the spirit or scope of the present disclosure. Thus, it is intended that the present disclosure covers the modifications and variations of this present disclosure provided they come within the scope of the appended claims and their equivalents.

What is claimed is:

1. A vehicle antenna for supporting a vehicle to vehicle communication and a vehicle to infrastructure communication, the vehicle antenna comprising:

a substrate unit;

a first directional radiator formed inside the substrate unit that is configured for vehicle to vehicle communication;

a second directional radiator extending in a Z direction from a central position of the first directional radiator that is configured for vehicle to infrastructure communication; and an induction coupler formed between the first directional radiator and the second directional radiator and configured to apply an induced current with a designated level to the first directional radiator and the second directional radiator;

a power feeder formed within the substrate unit, where an upper part of the power feeder is configured to contact a lower part of the first directional radiator; and a ground part formed at a lower part of the substrate unit and configured to contact a lower part of the power feeder, wherein the induction coupler is formed in a cross shape starting from a center of the second directional radiator.

2. The vehicle antenna according to claim 1, wherein the ground part is formed of a conductive material.

3. The vehicle antenna according to claim 1, wherein, when the induction coupler includes a first induction coupler part formed in a X direction and a second induction coupler part formed in a Y direction and intersecting the first induction coupler part, a length of one side of the first induction coupler part and a length of one side of the second induction coupler part except for an intersection region therebetween are equal.

4. The vehicle antenna according to claim 3, wherein the lengths of the sides of the first and second induction coupler parts are within a range of 1.4~1.8 mm.

5. The vehicle antenna according to claim 3, wherein a width of an end of the first induction coupler part or the second induction coupler part is within a range of 0.02~2 mm.

6. The vehicle antenna according to claim 3, wherein the length of one side of the first induction coupler part and the length of one side of the second induction coupler part except for the intersection region therebetween have different values within a range of 1.4~1.8 mm.

7. The vehicle antenna according to claim 1, wherein the second directional radiator comprises:

a first XY directional radiator part having a rod shape and formed at the central position of the first directional radiator; and a second XY directional radiator part having a pillar shape and formed at an upper end of the first XY directional radiator part.

8. The vehicle antenna according to claim 7, wherein the pillar-shaped second XY directional radiator part serves as a load.

9. The vehicle antenna according to claim 1, wherein the first directional radiator, the second directional radiator and the induction coupler are formed of a conductive material.

10. The vehicle antenna according to claim 1, wherein the second directional radiator is operated in a monopole mode and the first directional radiator is operated in a patch mode.

11. The vehicle antenna according to claim 1, wherein the power feeder is biased in a X direction within the substrate unit so that the first directional radiator or the second directional radiator has radiation directivity in a ZX direction, or is biased in a Y direction within the substrate unit so that the first directional radiator or the second directional radiator has radiation directivity in a ZY direction.

12. A vehicle communication system for supporting a vehicle to vehicle communication and a vehicle to infrastructure communication, the vehicle communication system comprising:

a first vehicle antenna within a first vehicle, the first vehicle antenna connected to a second vehicle antenna within a second vehicle by the vehicle to vehicle communication and connected to a third vehicle antenna of a communication target by the vehicle to infrastructure communication, wherein the first vehicle antenna includes:

a first directional radiator configured to execute the vehicle to vehicle communication;

a second directional radiator extending in a Z direction from a central position of the first directional radiator so as to execute the vehicle to infrastructure communication;

an induction coupler formed between the first directional radiator and the second directional radiator and configured to apply an induced current with a designated level to the first directional radiator and the second directional radiator;

a substrate unit formed along an edge of the first directional radiator such that the first directional radiator is formed inside the substrate unit;

a power feeder formed within the substrate unit, an upper part of the power feeder configured to contact a lower part of the first directional radiator; and a ground part formed at the lower part of the substrate unit and configured to contact a lower part of the power feeder.

13. The vehicle communication system according to claim 12, wherein the induction coupler is formed in a cross shape starting from a center of the second directional radiator.

14. The vehicle communication system according to claim 13, wherein, when the induction coupler includes a first induction coupler part formed in a X direction and a second induction coupler part formed in a Y direction and intersecting the first induction coupler part, a length of one side of the first induction coupler part and a length of one side of the second induction coupler part except for an intersection region therebetween are equal within a range of 1.4~1.8 mm.

15. The vehicle communication system according to claim 12, wherein the second directional radiator comprises:

a first XY directional radiator part having a rod shape and formed at the central position of the Z directional radiator; and a second XY directional radiator part having a pillar shape and formed at an upper end of the first XY directional radiator part, wherein the pillar-shaped second XY directional radiator part serves as a load.

16. The vehicle communication system according to claim 12, wherein the power feeder is biased in a X direction within the substrate unit so that the first directional radiator or the second directional radiator has radiation directivity in a ZX direction, or is biased in a Y direction within the substrate unit so that the first directional radiator or the second directional radiator has radiation directivity in a ZY direction.

* * * * *